US009821436B1

(12) United States Patent
Smith

(10) Patent No.: US 9,821,436 B1
(45) Date of Patent: Nov. 21, 2017

(54) MULTI-ANGLE BLADE SHARPENER ASSEMBLY

(71) Applicant: Barry G. Smith, Omaha, NE (US)

(72) Inventor: Barry G. Smith, Omaha, NE (US)

( * ) Notice: Subject to any disclaimer, the term of this patent is extended or adjusted under 35 U.S.C. 154(b) by 230 days.

(21) Appl. No.: 14/977,862

(22) Filed: Dec. 22, 2015

(51) Int. Cl.
*B24D 15/00* (2006.01)
*B24D 15/06* (2006.01)

(52) U.S. Cl.
CPC ..... *B24D 15/06* (2013.01)

(58) Field of Classification Search
CPC ..... B24D 15/06; B24D 15/08; B24D 15/081; B24D 15/063; B24D 15/065
USPC ..... 451/552; 76/82, 84
See application file for complete search history.

(56) References Cited

U.S. PATENT DOCUMENTS 1,429,984 A * 9/1922 Vollmer ..... B24D 15/081 76/86
4,912,885 A * 4/1990 Bonapace ..... B24D 15/081 451/45
5,477,753 A * 12/1995 Branscum ..... B24D 15/08 451/552
5,860,641 A * 1/1999 Heath ..... A47J 47/005 269/289 R
6,881,137 B2 4/2005 Friel, Sr.
7,172,500 B1 * 2/2007 Wu ..... B24D 15/081 451/319
D675,502 S * 2/2013 Carleton ..... D8/93
2004/0077299 A1 * 4/2004 Friel, Sr. ..... B24D 15/08 451/344
2009/0275272 A1 * 11/2009 Bonapace ..... B24D 15/082 451/321
2015/0151408 A1 * 6/2015 Jhones ..... B24D 15/06 451/552

* cited by examiner

*Primary Examiner* — Larry E Waggle, Jr.
*Assistant Examiner* — Henry Hong
(74) *Attorney, Agent, or Firm* — Dennis L. Thomte; Thomte Patent Law Office LLC

(57) ABSTRACT

A multi-angle blade sharpener is provided which includes a support plate having a plurality of a pair of bores extending downwardly into the support plate with each pair of bores extending downwardly into the support plate at different angles. First and second sharpening stone holders having a sharpening stone secured thereto are also provided with each of the holders having a stud extending downwardly therefrom for insertion to the pairs of bores. A storage box is also provided for storing the components of the sharpener with the support plate serving as a cover for the box.

9 Claims, 7 Drawing Sheets

MULTI-ANGLE BLADE SHARPENER ASSEMBLY

BACKGROUND OF THE INVENTION

Field of the Invention

This invention relates to a multi-angle blade sharpener assembly. The invention also relates to a box for storing the components of the assembly therein with the support plate of the assembly also functioning as a lid or cover for the box.

Description of the Related Art

Hundreds of blade sharpener devices have been patented. Many of those devices utilize sharpening stones since, when used properly, they are the most effective method to sharpen knives and small tools such as wood chisels. The sharpening stones are inexpensive, have a long life, and are readily available.

Many cutting edges of blades have at least two opposing facets or blade angles which require sharpening. The most common blade angles or facets are 10, 14, 18, 21, 25 and 30 degrees. The use of a flat position single sharpening stone has multiple issues. First, it is unsafe to repeatedly flip the blade to sharpen both facets or angles. Second, it is difficult to maintain the correct blade edge sharpening angle. Third, it is difficult to track equal strokes to both sides of the edge. Fourth, it is difficult to control the water or cutting oil or mess.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A multi-angle blade sharpener assembly for blades with a cutting edge with two blade angles or facets is disclosed. The sharpener assembly includes a rectangular support plate having a first end, a second end, a first side, a second side, an upper side and a bottom side. A first bore extends downwardly into the upper side of the support plate at a first angle. A second bore extends downwardly into the upper side of the support plate at a second angle. The first and second bores are spaced-apart with the first and second angles being equal but opposite. A first sharpening stone holder having an upper end, a lower end, an inner side and an outer side is provided with the first sharpening stone holder having a cylindrical stud extended downwardly from the lower end thereof. A first sharpening stone is selectively removably secured to the first sharpening stone holder at the inner side thereof. The stud of the first sharpening stone holder is selectively removably extended downwardly into the first bore whereby the first sharpening stone holder and the first sharpening stone thereon extend upwardly and laterally from the support plate.

The blade sharpener also includes a second sharpening stone holder having an upper end, a lower end, an inner side and an outer side. The second sharpening stone holder has a cylindrical stud extending downwardly from the lower end thereof. A second sharpening stone is selectively removably secured to the second sharpening stone holder at the inner side thereof. The stud of the second sharpening stone holder is selectively removably extended downwardly into the second bore whereby the second sharpening stone holder and the second sharpening stone thereon extend upwardly and laterally from the support plate.

In the preferred embodiment, third and fourth bores extend downwardly into the upper side of the support plate at third and fourth angles respectively with the third and fourth bores being spaced-apart and wherein the third and fourth angles are equal but opposite and are different than the first and second angles with the third and fourth bores being configured to selectively removably receive the studs of the first and second sharpening stone holders respectively.

In the preferred embodiment, fifth and sixth bores extend downwardly into the upper side of the support plate at fifth and sixth angles respectively with the fifth and sixth bores being spaced-apart and with the fifth and sixth angles being equal and opposite and which are different than the third and fourth angles. The fifth and sixth bores are configured to selectively removably receive the studs of the first and second sharpening stone holders respectively.

In the preferred embodiment, seventh and eighth bores also extend downwardly into the upper side of the support plate at seventh and eighth angles respectively and wherein each of the seventh and eighth bores extend downwardly into the upper side at seventh and eighth angles with the seventh and eighth bores being spaced-apart and with the seventh and eighth angles being equal but opposite and which are different than the fifth and sixth angles and which are configured to selectively removably receive the studs of the first and second sharpening stone holders respectively.

The preferred embodiment also includes ninth and tenth bores extending downwardly into the upper side of the support plate at ninth and tenth angles respectively with the ninth and tenth bores being spaced-apart and with the ninth and tenth angles being equal but opposite. The angles of the ninth and tenth bores are different than the angles of the seventh and eighth angles with the ninth and tenth bores being configured to selectively removably receive the studs of the first and second sharpening stone holders respectively.

In the preferred embodiment, eleventh and twelfth bores extend downwardly into the upper side of the support plate at eleventh and twelfth angles respectively with the eleventh and twelfth bores being spaced-apart with the eleventh and twelfth angles being equal but opposite and which are different than the ninth and tenth angles. The eleventh and twelfth bores are configured to selectively removably receive the studs of the first and second sharpening stone holders respectively.

It is therefore a principal object of the invention to provide a blade sharpener including a pair of sharpening stones positioned in multi-angle holders which enables a person to sharpen both sides of knives, tools, and other instruments needing sharpening without flipping the blades thereof.

A further object of the invention is to provide a blade sharpener which may be held securely in one hand.

A further object of the invention is to provide a blade sharpener which is safe to use.

A further object of the invention is to provide a blade sharpener which has no moving parts which may require repair or replacement.

A further object of the invention is to provide a blade sharpener wherein it is easy to maintain the desired blade edge angle.

A further object of the invention is to provide a blade sharpener including first and second sharpening stones which are snap-fitted into first and second sharpening stone holders respectively.

A further object of the invention is to provide a blade sharpener wherein each of the first and second sharpening stone holders include a flat base and spaced-apart side walls.

A further object of the invention is to provide a storage box for the blade sharpener wherein the support plate of the blade sharpener assembly functions as a lid or cover for the box.

A further object of the invention is to provide a blade sharpener which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
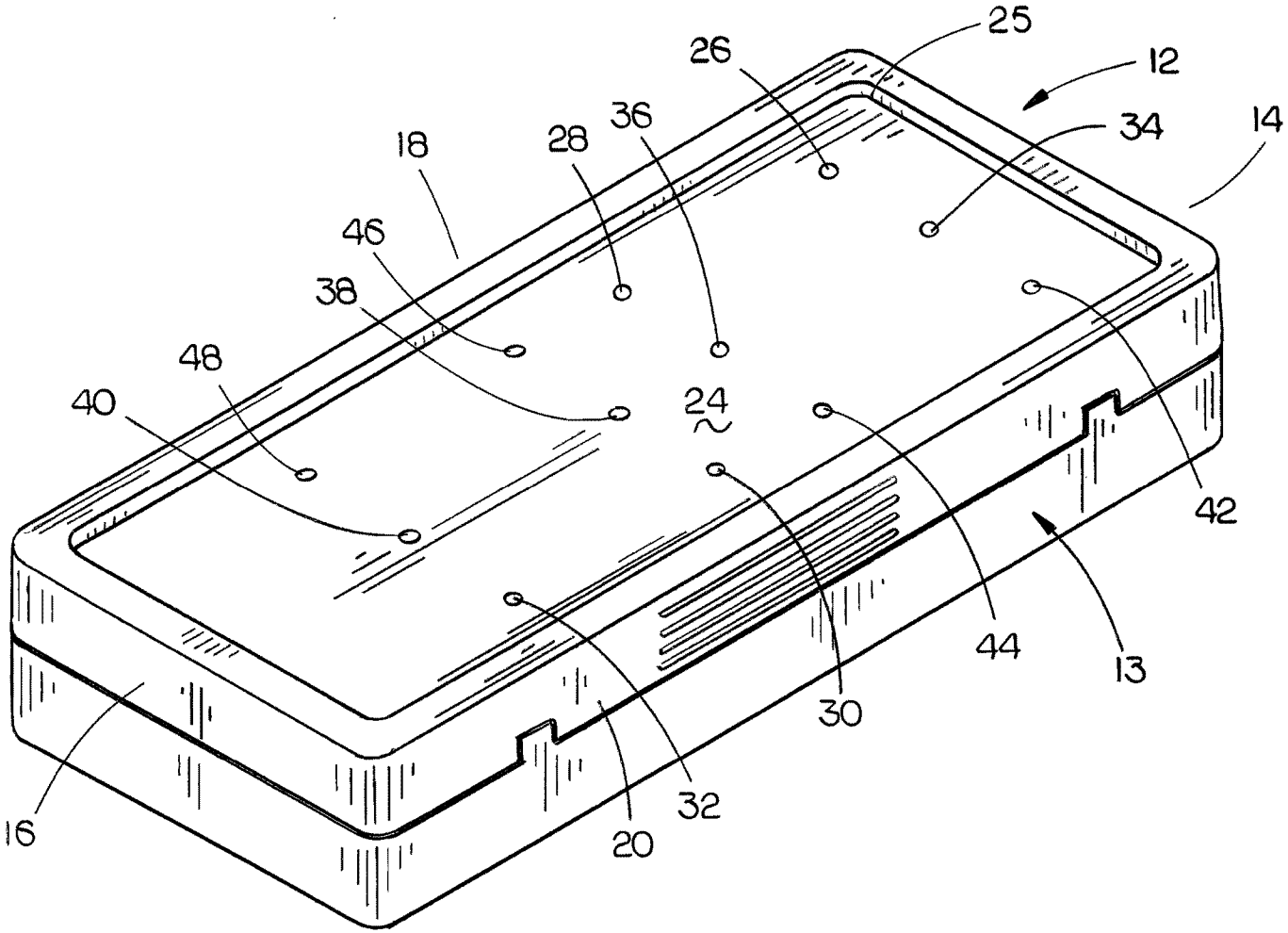
FIG. 1 is a perspective view of the storage box of this invention with the support plate of the invention serving as a lid or cover for the storage box.
Figure 2:
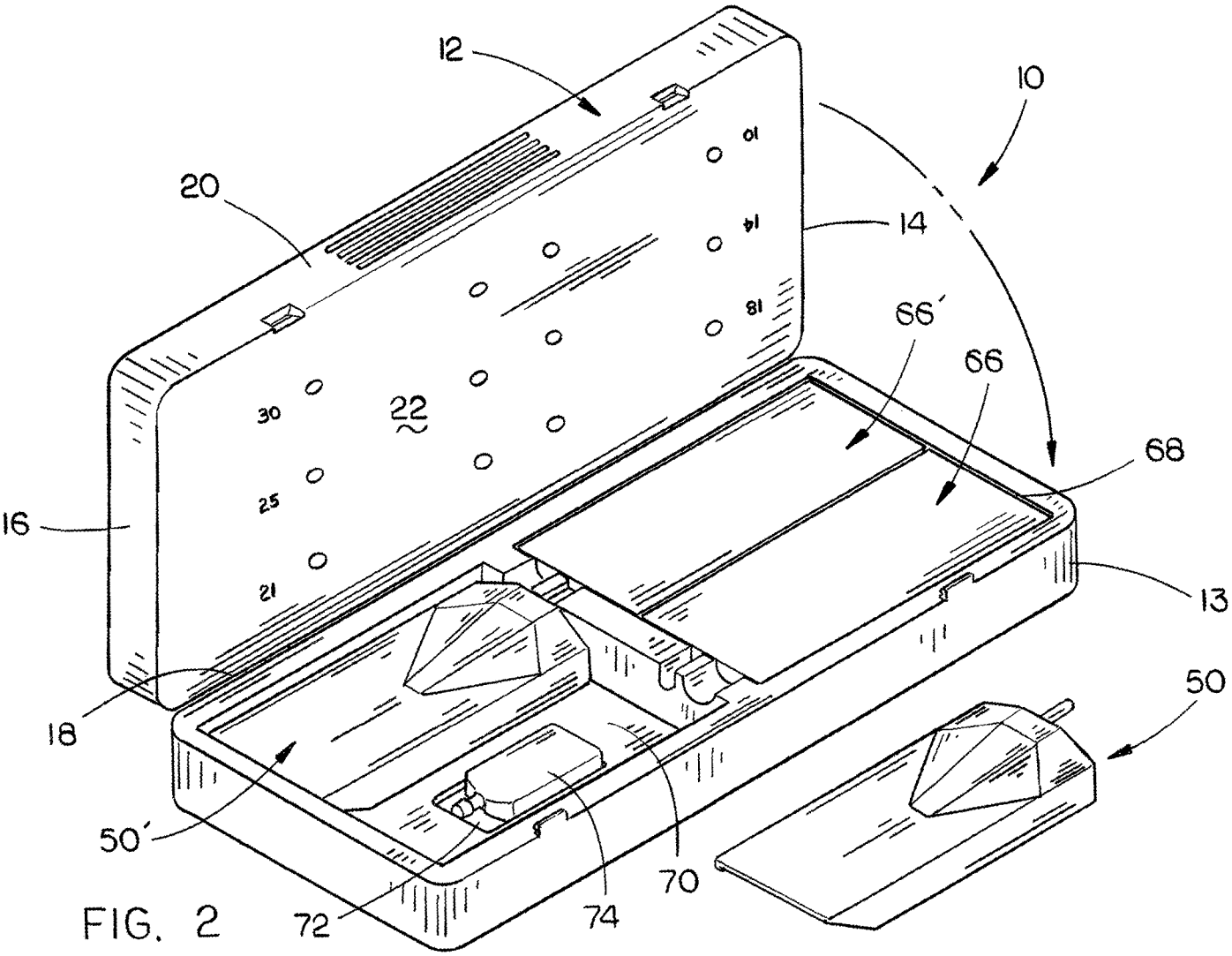
FIG. 2 is a partial exploded perspective view illustrating the support plate/lid being partially opened.
Figure 3:
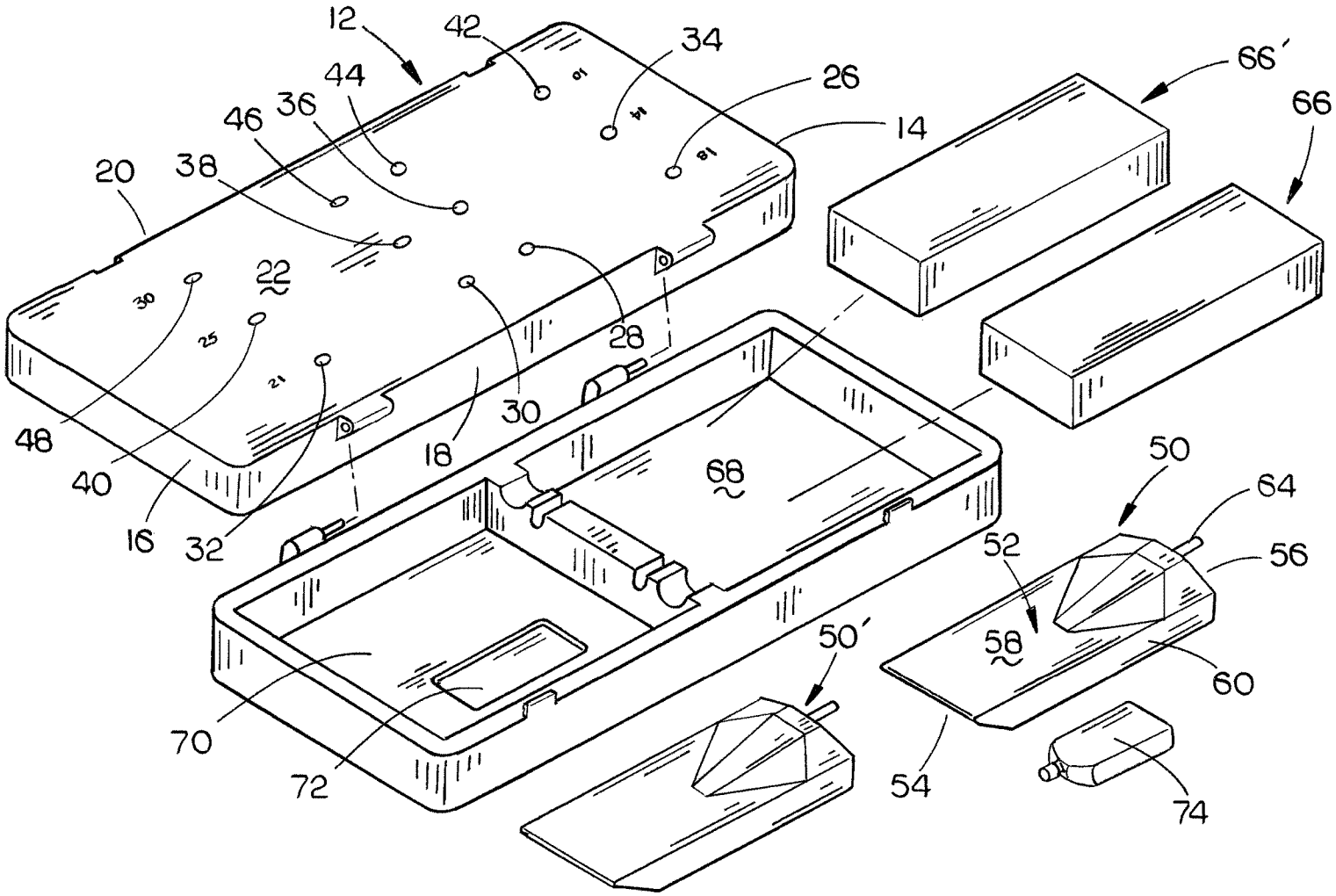
FIG. 3 is a view similar to FIG. 2 but which illustrates the support plate/lid being detached from the box.
Figure 4:
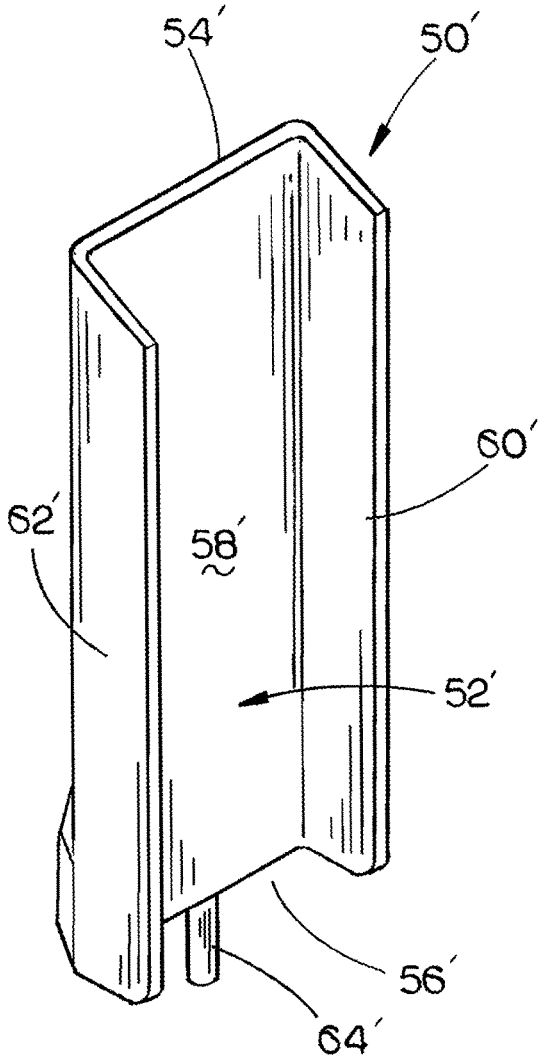
FIG. 4 is a perspective view of the second sharpening stone holder.
Figure 5:
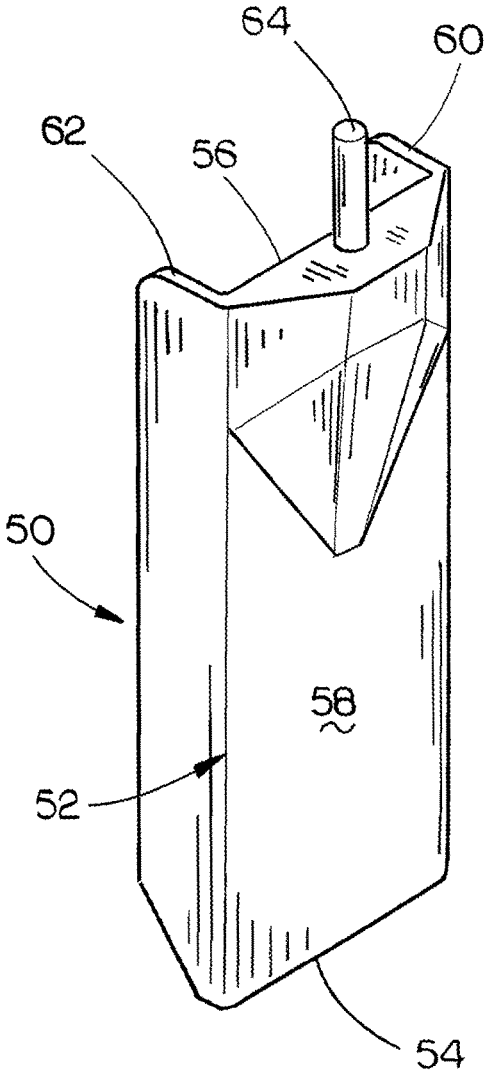
FIG. 5 is a perspective view of the first sharpening stone holder.
Figure 6:
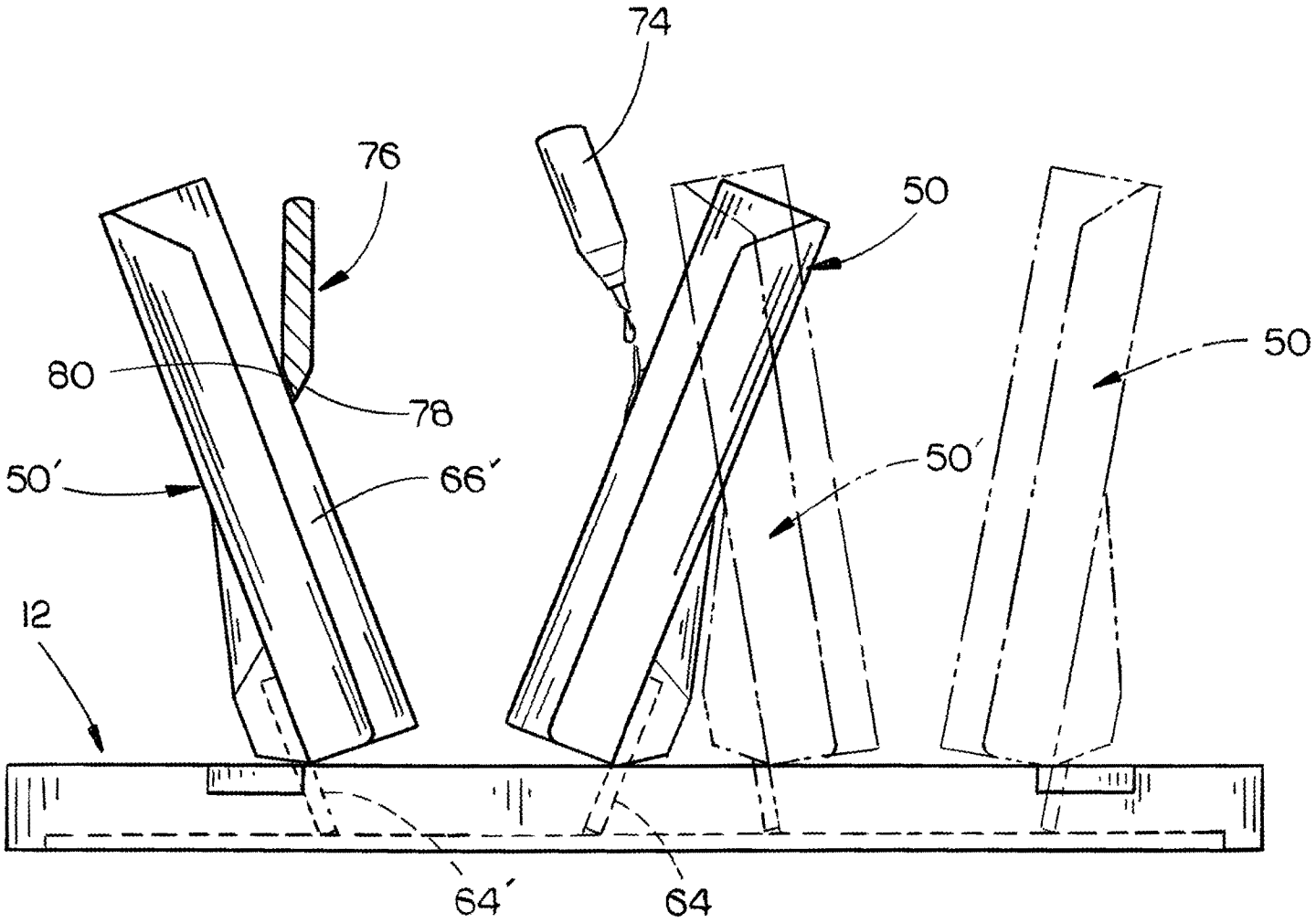
FIG. 6 is a side elevation view which illustrates the first and second sharpening stone holders in a first position and with broken lines illustrating the first and second sharpening stone holders in a second position.
Figure 7:
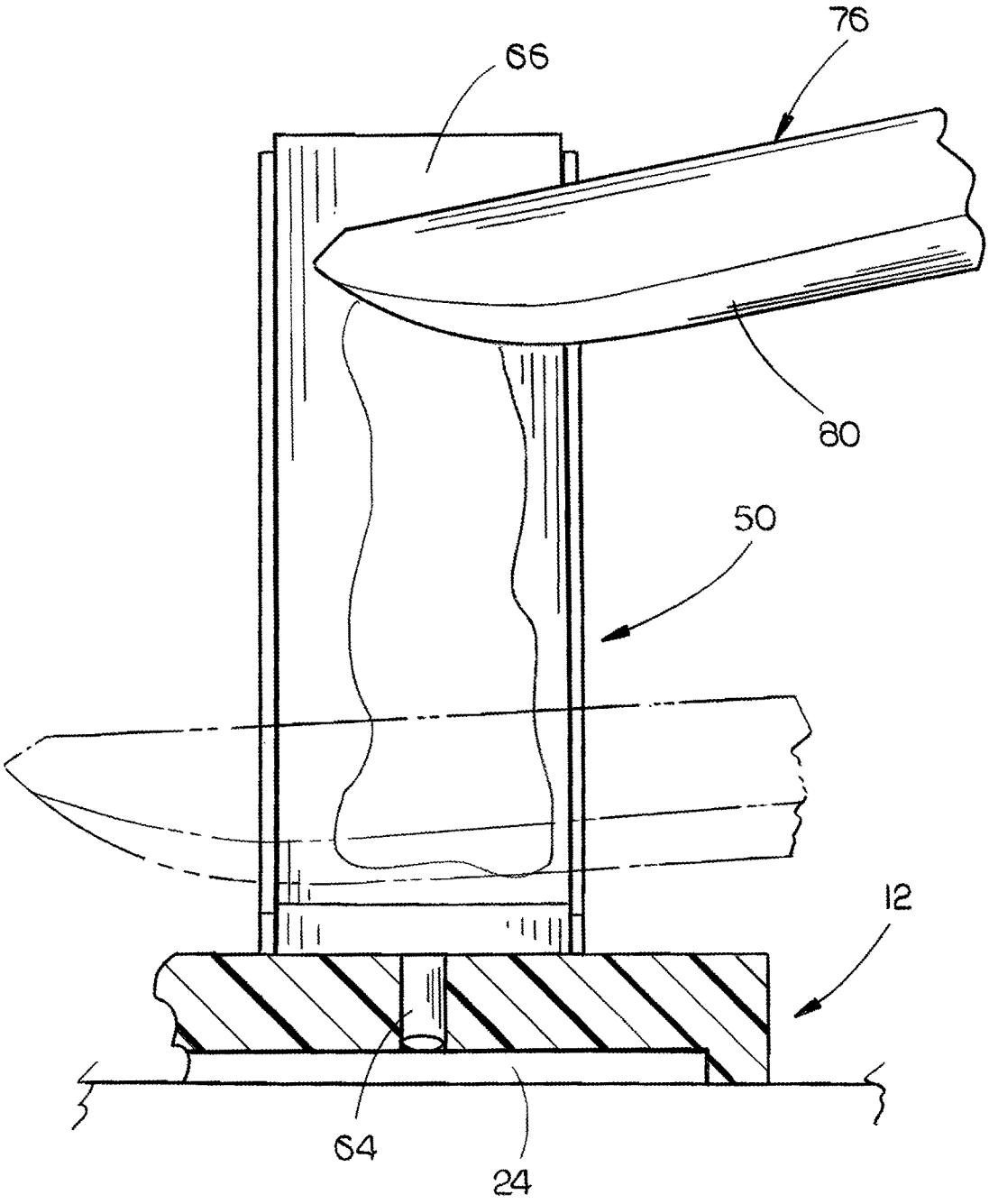
FIG. 7 is a partial sectional view illustrating the manner in which a knife blade may be sharpened.
Figure 8:
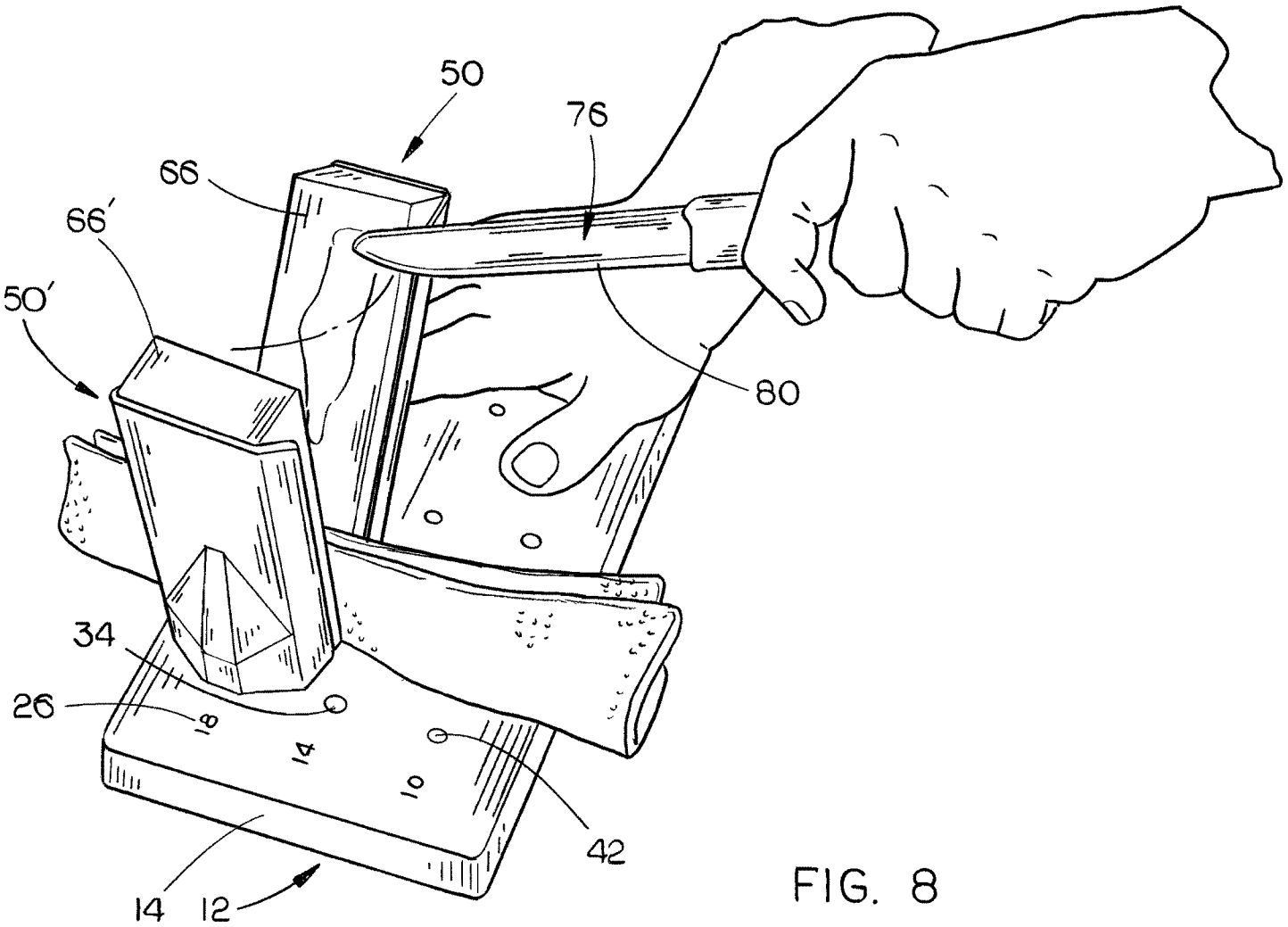
FIG. 8 is a perspective view illustrating a blade being sharpened through the use of the invention.

The blade sharpener of this invention is designated by the reference numeral 10. Sharpener 10 includes a horizontally disposed support plate 12 which is preferably rectangular in shape. Support plate 12 also serves as the lid of a container on box 13 as will be described in more detail hereinafter. Support plate 12 includes a first end 14, a second end 16, a first side 18, a second side 20, an upper side 22 and a bottom side 24. Bottom side 24 of support plate 12 has a rectangular recess 25 formed therein. When the support plate 12 is functioning as a lid, the bottom side 24 will be facing upwardly as seen in FIG. 1.

Bores, sockets or openings 26, 28, 30 and 32 extend downwardly into the upper side 22 of support plate 12 in a spaced-apart manner inwardly of side 18 thereof. Bores 34, 36, 38 and 40 extend downwardly into the upper side 22 of support plate 12 intermediate sides 18 and 20 in a spaced-apart manner. Bores 42, 44, 46 and 48 extend downwardly into the upper side 22 of support plate 12 inwardly of side 20 in a spaced-apart manner. For purposes of description, bores 26 and 28 will be described as being a first pair of bores, bores 34 and 36 will be described as being a second pair of bores, and bores 42 and 44 will be described as being a third pair of bores. Bores 30 and 32 will be described as being a fourth pair of bores, bores 38 and 40 will be described as being a fifth pair of bores and bores 46 and 48 will be described as being a sixth pair of bores.

Bore 42 extends downwardly into support plate 12 at approximately a 10 degree angle as does bore 44. The angles of bores 42 and 44 are the same but opposite to one another. In other words, the bores 42 and 44 extend inwardly into support plate 12 so as to extend slightly towards one another. Bores 34 and 36 extend downwardly into support plate 12 at approximately a 14 degree angle. Bores 26 and 28 extend downwardly into support plate 12 at approximately an 18 degree angle. Bores 30 and 32 extend downwardly into support plate 12 at approximately a 21 degree angle. Bores 38 and 40 extend downwardly into support plate 12 at approximately a 25 degree angle. Bores 46 and 48 extend downwardly into support plate 12 at approximately a 30 degree angle. The 10, 14, 18, 21, 25 and 30 degree angles correspond to the most common cutting edge facet angles plus or minus 1 degree.

The numeral 50 refers to a first sharpening stone holder while the numeral 50' refers to a second sharpening stone holder which is identical to holder 50, only holder 50 will be described in detail with "'" indicating identical structure on holder 50'.

Holder 50 includes a body member 52 having an upper end 54 and a lower end 56. Body member 52 includes a flat base portion 58 and side walls 60 and 62. Holder 50 may be constructed of plastic or metal. An elongated cylindrical stud 64 extends downwardly from the lower end 56 of body member 52 and which is configured to be selectively removably inserted into one of the bores formed in support plate 12 as will be described hereinafter. The numeral 66 refers to a conventional sharpening stone member which is snap-fitted into body member 52 between the side walls 60 and 62 of body member 52 as seen in the drawings. Sharpening stone member 66' is snap-fitted into body member 52' between the side walls 60' and 62' of body member 52'.

If it is desired to sharpen a blade having 10 degree facets, the stud 64 of holder 50 will be inserted into bore 42 of support plate 12 and the stud 64' of holder 50' will be inserted into bore 44 of support plate 12. If it is desired to sharpen a blade having 14 degree facets, the stud 64 of holder 50 will be inserted into bore 34 of support plate 12 and stud 64' of holder 50' will be inserted into bore 36 of support plate 12. If it is desired to sharpen a blade having 18 degree facets, stud 64 of holder 50 will be inserted into bore 26 of support plate 12 and stud 64' of holder 50' will be inserted into bore 28 of support plate 12. If it is desired to sharpen a blade having 21 degree facets, stud 64 of holder 50 will be inserted into bore 30 of support plate 12 and stud 64' of holder 50' will be inserted into bore 32 of support plate 12. If it is desired to sharpen a blade having 25 degree facets, stud 64 of holder 50 will be inserted into bore 38 of support plate 12 and stud 64' of holder 50' will be inserted into bore 40 of support plate 12. If it is desired to sharpen a blade having 30 degree facets, stud 64 of holder 50 will be inserted into bore 46 of support plate 12 and stud 64' of holder 50' will be inserted into bore 48 of support plate 12.

Box 13 includes a compartment 68 which receives the sharpener stones 66 and 66' for the storage of the blade sharpener 10. Box 13 also includes a compartment 70 which receives the sharpening stone holders 50 and 50'. Box 13 also has a small compartment 72 formed therein which receives a bottle 74 of sharpening oil. Support plate 12, when functioning as a lid for box 13, is selectively pivotally secured to box 13 so as to selectively close the upper end of box 13.

The numeral 76 refers to a knife blade having blade angles or facets 78 and 80.

The assembly of this invention is used as will now be described. Assuming that the components of the assembly are positioned in the box 13, support plate 12 is opened and detached from the box 13. The support plate 12 is then placed on a horizontally disposed supporting surface. The holders 50 and 50' are removed from the box 13. The sharpening stones 66 and 66' are then snap-fitted onto the holders 50 and 50' respectively. Assuming that the facets 78 and 80 of the blade 76 are disposed at an angle of 10 degrees, the studs 64 and 64' of holders 50 and 50' respectively are inserted downwardly into bores 26 and 28 respectively. Cutting oil or water is then placed on the faces of the sharpening stones 66 and 66'. The blade 76 is then vertically inserted between the stones 66 and 66'. The blade 76 is then brought into contact with stone 66 so that facet 78 is brought into contact with stone 66. The blade 76 is then moved horizontally and downwardly to sharpen facet 78 as the blade 76 is moved along stone 66. The blade 76 is then brought into contact with stone 66' so that facet 80 is in contact with stone 66'. The horizontal and downwardly movement of blade 76 with respect to stone 66' sharpens facet 80.

The person sharpening the facets 78 and 80 repeats the movements described above until the blade 76 is sharpened. The person moves the blade 76 back and forth between the stones 66 and 66' with each facet being sharpened the same number of times which is easily remembered by the person.

If the blade 76 has facets with angles different than 10 degrees, other pairs of the bores will be utilized.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A multi-angle blade sharpener assembly for blades with a cutting edge with two blade edge facets, comprising:

a rectangular support plate having a first end, a second end, a first side, a second side, an upper side and a bottom side;

a first bore extending downwardly into said upper side of said support plate at a first angle;

a second bore extending downwardly into said upper side of said support plate at a second angle;

said first and second bores being spaced-apart;

said first and second angles being equal but opposite;

a first sharpening stone holder having an upper end, a lower end, an inner side, and an outer side;

said first sharpening stone holder having a cylindrical stud extending downwardly from said lower end thereof;

a first sharpening stone selectively removably secured to said first sharpening stone holder at said inner side thereof;

said stud of said first sharpening stone holder selectively removably extended downwardly into said first bore whereby said first sharpening stone holder extends upwardly and laterally from said support plate;

a second sharpening stone holder having an upper end, a lower end, an inner side, and an outer side;

said second sharpening stone holder having a cylindrical stud extend downwardly from said lower end thereof;

a second sharpening stone selectively removably secured to said second sharpening stone holder at said inner side thereof;

said stud of said second sharpening stone holder selectively removably extended downwardly into said second bore whereby said second sharpening stone holder extends upwardly and laterally from said support plate.

2. The blade sharpener assembly of claim 1 wherein a third bore extends downwardly into said upper side of said support plate at a third angle and wherein a fourth bore extends downwardly into said upper side of said support plate at a fourth angle, with said third and fourth bores being spaced-apart and wherein said third and fourth angles are equal but opposite and are different than said first and second angles, with said third and fourth bores being configured to selectively removably receive the studs of said first and second sharpening stone holders respectively.

3. The blade sharpener assembly of claim 2 wherein a fifth bore extends downwardly into said upper side of said support plate at a fifth angle and wherein a sixth bore extends downwardly to said upper side of said support plate at a sixth angle, with said fifth and sixth bores being spaced-apart and wherein said fifth and sixth angles are equal but opposite and are different than said third and fourth angles, with said fifth and sixth bores being configured to selectively removably receive the studs of said first and second sharpening stone holders respectively.

4. The blade sharpener assembly of claim 3 wherein a seventh bore extends downwardly into said upper side of said support plate at a seventh angle and wherein an eighth bore extends downwardly into said upper side of said support plate at an eighth angle, with said seventh and eighth bores being spaced-apart and wherein said seventh and eighth angles are equal but opposite and are different than said fifth and sixth angles, with said seventh and eighth bores being configured to selectively removably receive the studs of said first and second sharpening stone holders respectively.

5. The blade sharpener assembly of claim 4 wherein a ninth bore extends downwardly into said upper side of said support plate at a ninth angle and wherein a tenth bore extends downwardly into said upper side of said support plate, at a tenth angle with said ninth and tenth bores being spaced-apart and wherein said ninth and tenth angles are equal but opposite and are different than said seventh and eighth angles, with said ninth and tenth bores being configured to selectively removably receive the studs of said first and second sharpening stone holders respectively.

6. The blade sharpener assembly of claim 5 wherein an eleventh bore extends downwardly into said upper side of said support plate and an eleventh angle and wherein a twelfth bore extends downwardly into said upper side of said support plate at a twelfth angle, with said eleventh and twelfth bores being spaced-apart and wherein said eleventh and twelfth angles are equal but opposite are different than said ninth and tenth angles with said eleventh and twelfth bores being configured to selectively removably receive the studs of said first and second sharpening stone holders respectively.

7. The blade sharpener assembly of claim 1 wherein said first and second sharpening stones are snap-fitted to said first and second sharpening stone holders respectively.

8. The blade sharpener assembly of claim 1 wherein each of said first and second sharpening stone holders includes a flat base and spaced-apart side walls.

9. The blade sharpener assembly of claim 1 further including a storage box for components of the assembly and wherein said support plate also functions as a cover for said storage box.

* * * * *